US006216650B1

(12) United States Patent
Noguchi

(10) Patent No.: US 6,216,650 B1
(45) Date of Patent: Apr. 17, 2001

(54) STRATIFIED SCAVENGING TWO-CYCLE ENGINE

(75) Inventor: Masanori Noguchi, Higashimurayama (JP)

(73) Assignees: Komatsu Zenoah Co., Saitama; Petroleum Energy Center, Tokyo, both of (JP)

( * ) Notice: Subject to any disclaimer, the term of this patent is extended or adjusted under 35 U.S.C. 154(b) by 0 days.

(21) Appl. No.: 09/284,532

(22) PCT Filed: Oct. 15, 1997

(86) PCT No.: PCT/JP97/03714

§ 371 Date: Apr. 14, 1999

§ 102(e) Date: Apr. 14, 1999

(87) PCT Pub. No.: WO98/17902

PCT Pub. Date: Apr. 30, 1998

(30) Foreign Application Priority Data

Oct. 17, 1996 (JP) ..... 8-274989

(51) Int. Cl.[7] ..... F02B 33/04
(52) U.S. Cl. ..... 123/73 A; 123/73 C; 123/73 PP
(58) Field of Search ..... 123/65 R, 73 A, 123/73 C, 73 PP

(56) References Cited

U.S. PATENT DOCUMENTS

| | | | | |
|---|---|---|---|---|
| 3,190,271 | * | 6/1965 | Gudmundsen | 123/73 C |
| 3,916,851 | * | 11/1975 | Otani | 123/73 A |
| 4,075,985 | | 2/1978 | Iwai | 123/73 |
| 4,185,598 | * | 1/1980 | Onishi | 123/73 A |
| 4,253,433 | * | 3/1981 | Blair | 123/73 R |
| 4,625,688 | * | 12/1986 | Takayasu | 123/73 B |
| 5,503,119 | * | 4/1996 | Glover | 123/73 B |
| 5,775,274 | * | 7/1998 | Duret et al. | 123/73 A |

FOREIGN PATENT DOCUMENTS

| | | |
|---|---|---|
| 52-170913 | 12/1977 | (JP) . |
| 58-19304 | 4/1983 | (JP) . |
| 7-139358 | 5/1995 | (JP) . |

* cited by examiner

*Primary Examiner*—Willis R. Wolfe
*Assistant Examiner*—Hai Huynh
(74) *Attorney, Agent, or Firm*—Sidley & Austin

(57) ABSTRACT

The present invention relates to a stratified scavenging two-cycle engine, in which control of an air flow rate provides favorable acceleration performance and can prevent deterioration of exhaust gas. The stratified scavenging two-cycle engine includes a scavenging flow passage (3) for connection between a cylinder chamber **(4*a*) and a crank chamber (1*a*), an air flow passage (2) connected to the scavenging flow passage (3), an air flow rate control means (12) for controlling a flow rate of air fed to the scavenging flow passage (3) from the air flow passage (2), and a fuel mixture flow rate controller (11) for controlling a flow rate of a fuel mixture drawn into the crank chamber (1*a*) from a fuel mixture flow passage (10). The air flow rate controller (12) throttles an air flow rate at the time of acceleration. Alternatively, the air flow rate controller (12) is opened later than the mixture flow rate controller (11)** at the time of acceleration.

14 Claims, 7 Drawing Sheets

STRATIFIED SCAVENGING TWO-CYCLE ENGINE

TECHNICAL FIELD

The present invention relates to a stratified scavenging two-cycle engine, and more particularly to a stratified scavenging two-cycle engine, in which control of an air flow rate provides favorable acceleration performance and can prevent deterioration of exhaust gas.

BACKGROUND ART

As a conventional stratified scavenging two-cycle engine of this kind, a stratified scavenging two-cycle engine that includes a scavenging flow passage for connection between a cylinder chamber and a crank chamber and an air flow passage connected to the scavenging flow passage and that is structured in such a manner that pressure reduction in the crank chamber, with upward movement of a piston, permits a fuel mixture to be drawn into the crank chamber and permits air to be drawn into the crank chamber, through the scavenging flow passage from the air flow passage, is known. In the stratified scavenging two-cycle engine structured as described above, there is an advantage that combustion gas can be pushed out by air from the scavenging flow passage, thus making exhaust gas cleaner by greatly reducing an introduction of a fuel mixture during combustion gas expulsion.

In the aforesaid stratified scavenging two-cycle engine, however, there is a disadvantage that the fuel mixture is rarefied by air, whereby an air-fuel ratio (weight of air/weight of fuel) having a substantial ratio of air to fuel becomes thinner (increases), thus deteriorating acceleration performance. As a measure to improve acceleration performance, it is required that the air-fuel ratio is thickened (decreases) by increasing the supply amount of fuel also at a time of stationary engine speed in accordance with acceleration performance to draw an enriched fuel mixture into the crank chamber. In that case, however, an exhaust gas quality at the time of a stationary engine speed (i.e., other than a time of acceleration) deteriorates.

SUMMARY OF THE INVENTION

In view of the aforesaid disadvantages, an object of the present invention is to provide a stratified scavenging two-cycle engine, in which a fuel mixture and air are separately drawn and that controls a supplied flow rate of air to improve acceleration performance and to prevent deterioration of exhaust gas at a time of stationary engine speed and a time of acceleration.

To attain the aforesaid object, a stratified scavenging two-cycle engine according to the present invention is characterized by including a scavenging flow passage for connection between a cylinder chamber and a crank chamber, an air flow passage connected to the scavenging flow passage, an air flow rate controller for controlling a flow rate of air fed to the scavenging flow passage from the air flow passage, and a fuel mixture flow rate controller for controlling a flow rate of a fuel mixture drawn into the crank chamber from a fuel mixture flow passage, the aforesaid air flow rate controller throttling an air flow rate at the time of acceleration.

According to the aforesaid configuration, when a piston ascends, pressure in the crank chamber lowers so that a fuel mixture flows into the crank chamber, and air flows into the crank chamber through the scavenging flow passage from the air flow passage. Namely, the scavenging flow passage is filled with air, and inside the crank chamber, the fuel mixture is rarefied by air from the scavenging flow passage. Therefore, in the stratified scavenging two-cycle engine, an air-fuel ratio of a fuel mixture drawn from the fuel mixture flow passage is set in a higher range so as to make the air-fuel ratio optimum in combustion after the fuel mixture is rarefied by air.

Subsequently, when pressure in the cylinder chamber sharply rises by ignition of the fuel mixture in the cylinder chamber and the piston descends, pressure in the crank chamber rises. When the piston descends to a predetermined position, an exhaust port opens, for example, and combustion gas flows out of the exhaust port so that pressure in the cylinder chamber sharply drops, and a scavenging port which is an end portion on the side of the cylinder chamber of the scavenging flow passage opens. Then, air in the scavenging flow passage flows into the cylinder chamber, and subsequently the fuel mixture in the crank chamber flows into the cylinder chamber through the scavenging flow passage.

Specifically, combustion gas can be pushed out of the exhaust port by only air at a point in time when scavenge starts, thus preventing deterioration of exhaust gas due to an introduction of a fuel mixture. Moreover, a proper air-fuel ratio mixture fills the cylinder chamber, thereby also preventing deterioration of exhaust gas. Accordingly, exhaust gas can be cleaned at the time of stationary engine speeds.

Meanwhile, when the flow rate of a fuel mixture fed to the crank chamber is increased by the fuel mixture flow rate controller, engine speed increases. At the time of such engine acceleration, an air flow rate is throttled by the air flow rate controller. Hence, the flow rate of air flowing into the crank chamber is relatively lower than the flow rate of a fuel mixture flowing into the same crank chamber, as compared with stationary engine speeds.

Namely, a thicker air-fuel ratio fuel mixture fills the cylinder chamber, thus improving acceleration performance of the engine. At this time, since the supply amount of fuel is not increased at the time of acceleration as in the prior art, the supply amount of fuel is small even at the time of acceleration, thus preventing deterioration of exhaust gas more than in the prior art. In addition, in the stratified two-cycle engine of the present invention, the supply amount of fuel is not increased at the time of acceleration, whereby deterioration of exhaust gas can be prevented more than in the prior art even at the time of a stationary engine speed.

A stratified scavenging two-cycle engine according to the present invention is characterized by including a scavenging flow passage for connection between a cylinder chamber and a crank chamber, an air flow passage connected to the scavenging flow passage, an air flow rate controller for controlling a flow rate of air fed to the scavenging flow passage from the air flow passage, and a mixture flow rate controller for controlling a flow rate of a fuel mixture drawn into the crank chamber from a fuel mixture flow passage, the aforesaid air flow rate controller being opened later than the mixture flow rate controller at the time of acceleration.

According to the aforesaid configuration, the same effect as that of the aforesaid embodiment can be obtained. In this embodiment, the same effect that is described above is obtained at the time of acceleration, and moreover an air-fuel ratio becomes the same as that at stationary engine speed by eliminating delay when predetermined acceleration is obtained, whereby accelerating performance can be improved and exhaust gas after acceleration can be made cleaner than in the prior art.

BEST MODE FOR CARRYING OUT THE INVENTION

Figure 1:
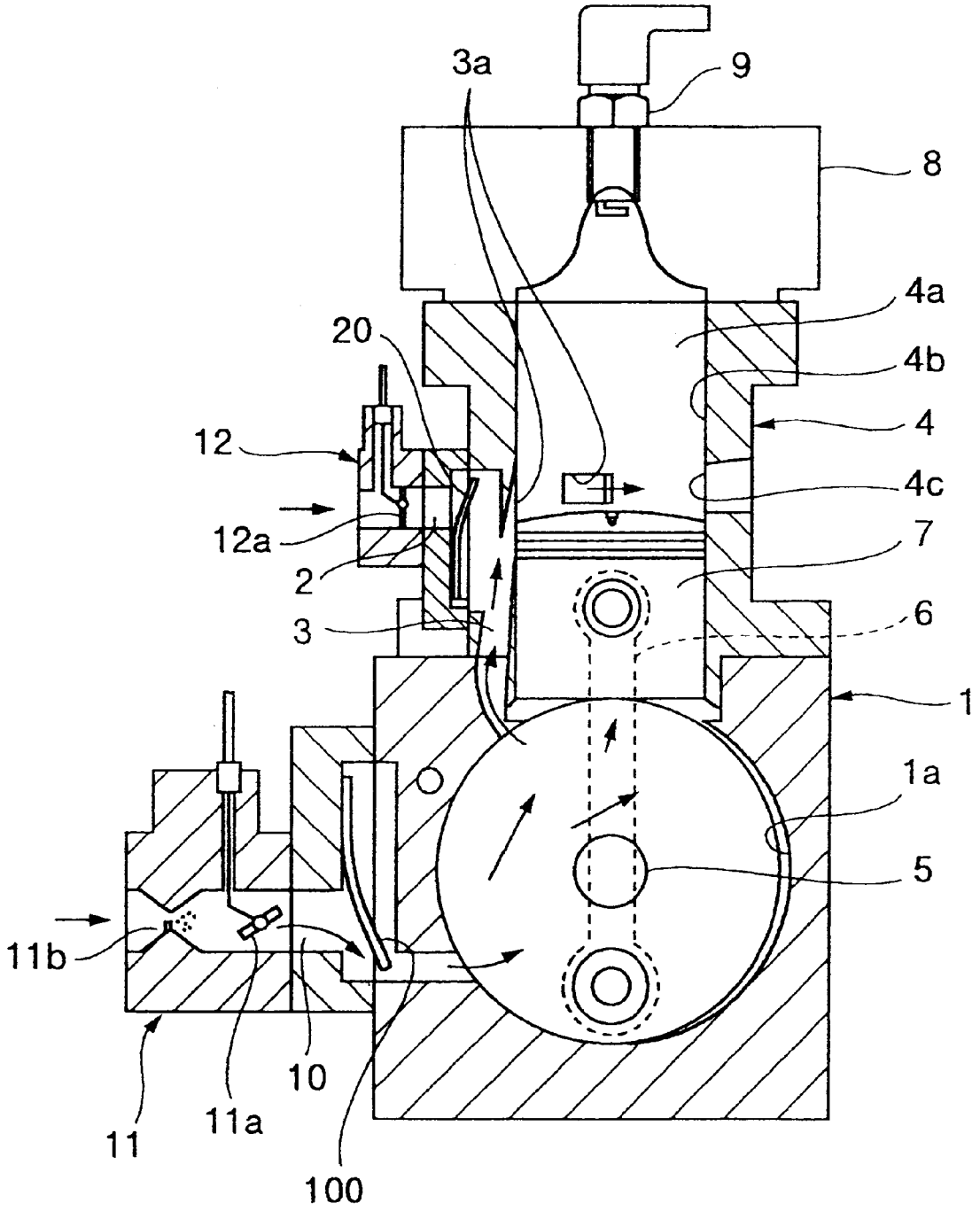
FIG. 1 is a sectional view of a stratified scavenging two-cycle engine according to one embodiment of the present invention, the engine being shown in a state of acceleration.
Figure 2:
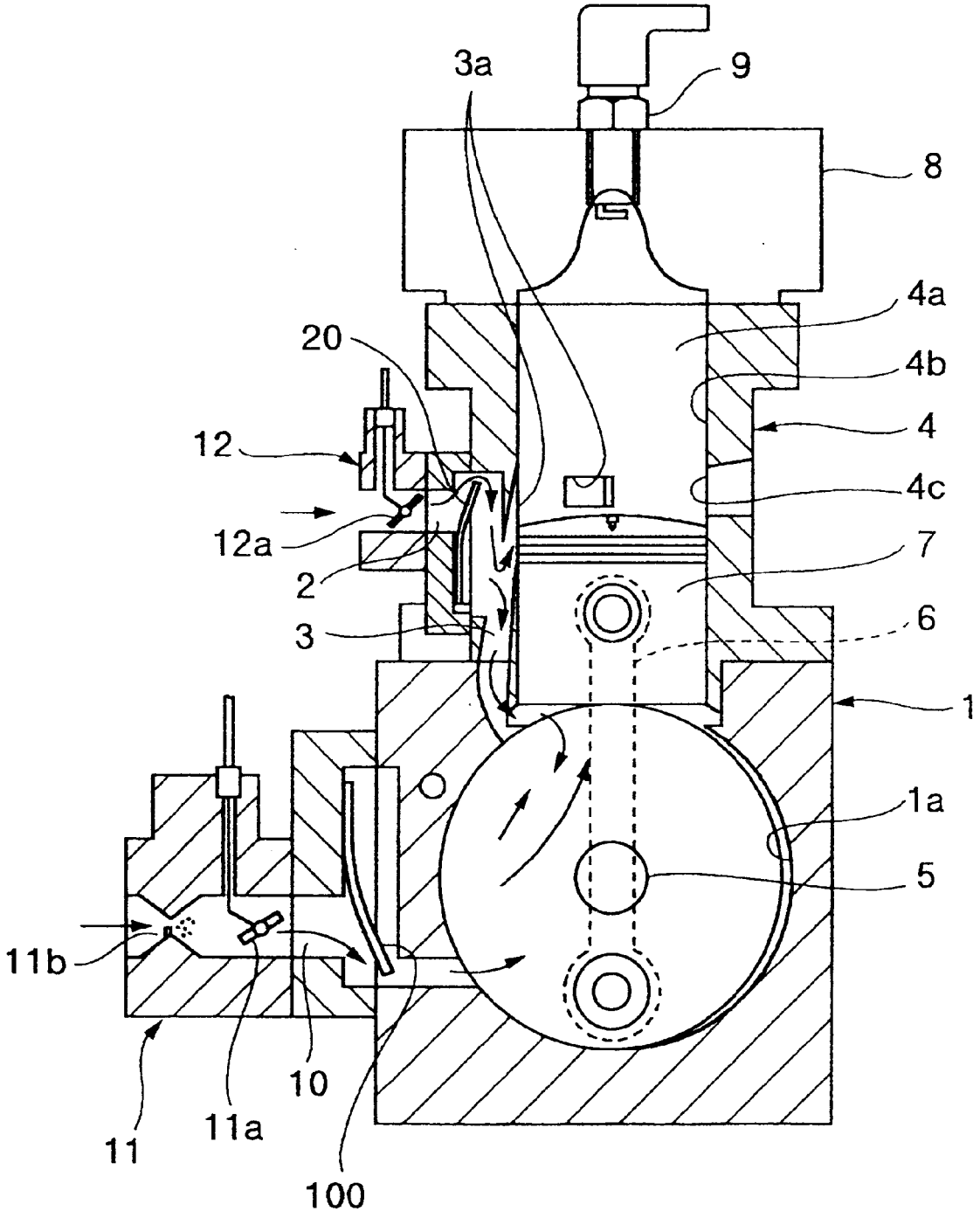
FIG. 2 is a sectional view of the stratified scavenging two-cycle engine of the one embodiment of the present invention, the engine being shown in a state of a stationary engine speed.

One embodiment of the present invention will be described below concerning the case of a crankcase reed valve-type engine with reference to FIG. 1 and FIG. 2. Incidentally, the same effect as the above can be obtained in the case of a piston valve-type engine. In a stratified scavenging two-cycle engine shown in this embodiment, as shown in FIGS. 1 and 2, a fuel mixture flow passage 10 that provides a fuel mixture is connected to a crank chamber 1*a*, and an air flow passage 2 that provides air is connected to a scavenging flow passage 3. A check valve 20 is provided at the outlet of the air flow passage 2. The check valve 20, which is formed by a reed valve, allows a flow from the air flow passage 2 toward the scavenging flow passage 3, and impedes a flow from the scavenging flow passage 3 toward the air flow passage 2. A check valve 100 is provided in the fuel mixture flow passage 10. The check valve 100 is also formed by a reed valve, allowing a flow from the fuel mixture flow passage 10 toward the crank chamber 1*a*, and impeding flow from the crank chamber 1*a* toward the fuel mixture flow passage 10.

Meanwhile, the scavenging flow passage 3 is provided in a crankcase 1 and a cylinder block 4 in order to lead from the crank chamber 1*a* into a cylinder chamber 4*a*. In a cylinder inner face 4*b*, scavenging ports 3*a* leading to the scavenging flow passage 3 are opened, and an exhaust port 4*c* for exhausting combustion gas is also opened.

A crankshaft 5 is provided in the crankcase 1, and a piston 7 is coupled to the crankshaft 5 via a connecting rod 6. The piston 7 is put into the cylinder chamber 4*a* and movable along the axial direction of the cylinder chamber 4*a*. In addition, a cylinder head 8 is provided on the cylinder block 4, and an ignition plug 9 is provided on the cylinder head 8.

A fuel mixture flow rate controller 11 for controlling a flow rate of a fuel mixture drawn into the crank chamber 1*a* is provided upstream of the fuel mixture flow passage 10. Moreover, an air flow rate control means 12 for controlling a flow rate of air drawn into the scavenging flow passage 3 from the air flow passage 2 is provided upstream of the air flow passage 2.

The fuel mixture flow rate controller 11 controls the flow rate of a fuel mixture with a throttle valve 11*a*. Specifically, by opening the throttle valve 11*a*, the flow rate of a fuel mixture drawn into the crank chamber 1*a* increases, whereby engine speed increases. In addition, in the fuel mixture flow rate controller 11, a carburetor 11*b* is integrally provided upstream of the throttle valve 11*a*.

The air flow rate controller 12 controls the flow rate of air with an on-off valve 12*a*. The on-off valve 12*a* throttles an opening when the flow rate of a fuel mixture fed to the crank chamber 1*a* is increased by the throttle valve 11*a* and engine speed is increased, that is, at the time of engine acceleration. Specifically, the on-off valve 12*a* detects that the throttle valve 11*a* is changing in an opening direction and throttles an air flow rate.

In the stratified two-cycle engine structured as described above, as shown in FIG. 2, when the piston 7 ascends, pressure in the crank chamber 1*a* lowers so that a fuel mixture flows into the crank chamber 1*a* from the mixture flow passage 10, and air flows into the crank chamber 1*a* through the scavenging flow passage 3 from the air flow passage 2. Namely, the scavenging flow passage 3 is filled with air, and inside the crank chamber 1*a*, the supplied mixture is rarefied by air. Therefore, an air-fuel ratio of a fuel mixture drawn from the fuel mixture flow passage 10 is set in a lower range so as to make the air-fuel ratio optimum in combustion after the fuel mixture is rarefied by air.

Subsequently, when pressure in the cylinder chamber 4*a* sharply rises by ignition of a fuel mixture in the cylinder chamber 4*a*, the piston 7 descends, and pressure in the crank chamber 1*a* rises. When the piston 7 descends to a predetermined position, the exhaust port 4*c* opens, and combustion gas flows out of the exhaust port 4*c* so that pressure in the cylinder chamber 4*a* sharply drops and the scavenging ports 3*a* open. Then, air in the scavenging flow passage 3 flows into the cylinder chamber 4*a*, and subsequently the fuel mixture in the crank chamber 1*a* flows into the cylinder chamber 4*a* through the scavenging flow passage 3.

Specifically, combustion gas can be pushed out of the exhaust port 4*c* by only air at a point in time when scavenge starts, thus preventing deterioration of exhaust gas due to an introduction of uncombusted fuel mixture. Moreover, a proper air-fuel ratio mixture can fill the cylinder chamber 4*a*, thereby also preventing deterioration of exhaust gas. Accordingly, exhaust gas can be cleaned at the time of stationary travel shown in FIG. 2.

Meanwhile, when the flow rate of a fuel mixture fed to the crank chamber 1*a* increases by the mixture flow rate controller 11, engine speed increases. At the time of such acceleration, an air flow rate is throttled by the air flow rate controller 12, as shown in FIG. 1. Hence, the flow rate of air flowing into the crank chamber 1*a* is relatively lower than the flow rate of a fuel mixture flowing into the same crank chamber 1*a* at stationary engine speeds, e.g., idle. Namely, a lower air-fuel ratio fuel mixture fills the cylinder chamber 4*a*, thus improving acceleration performance of the engine. Since the total amount of fed fuel is smaller than in the prior art, with delay of a supplied quantity, exhaust gas at the time of acceleration can be made cleaner than in the prior art. Moreover, since the supply amount of fuel no longer needs to be determined in view of an air-fuel ratio at the time of acceleration, the supply amount of fuel can be set in a lower range at a stationary engine speed, and exhaust gas can be made cleaner than in the prior art.

Figure 3:
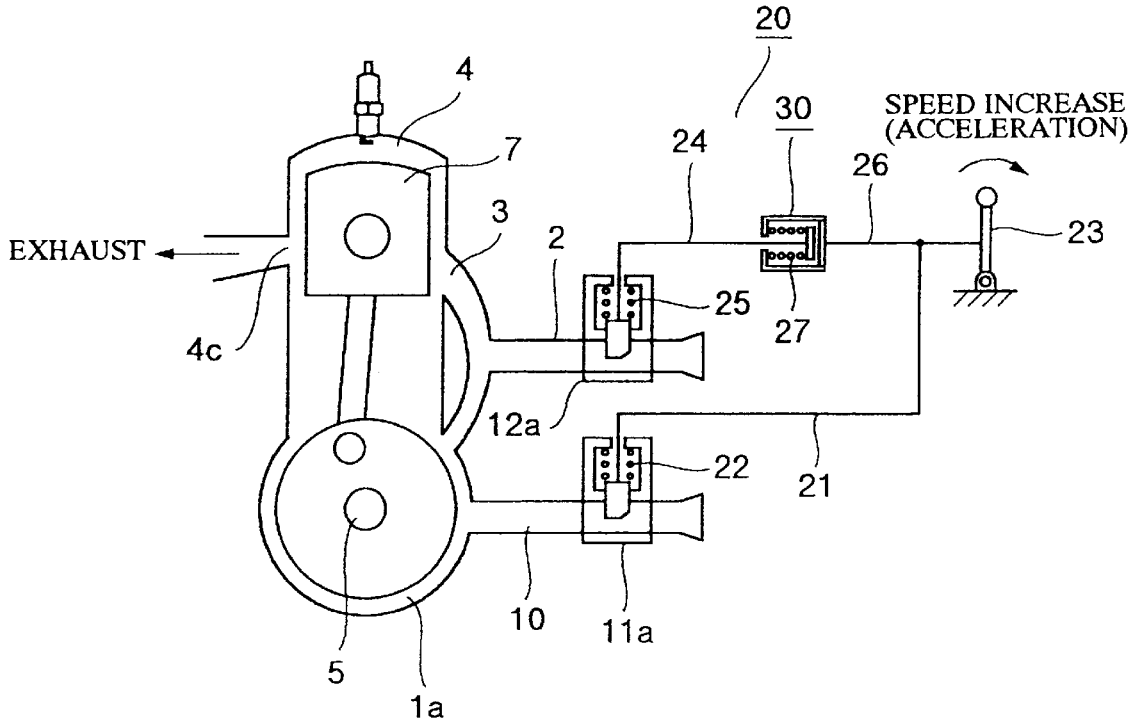
FIG. 3 is a schematic view of a first embodiment of an air supply delay device for the one embodiment of the present invention.

Next, a case will be explained where an air flow rate is throttled by the aforesaid air flow rate controller 12 and the air flow rate flows into the crank chamber 1*a* later than a fuel mixture flow rate. FIG. 3 shows a schematic view of a first embodiment of an air supply delay device 20, which is controlled by a mechanism, to supply a later air flow rate. A fuel mixture link 21 is linked to the throttle valve 11*a* of the fuel mixture flow rate controller 11 (shown in FIG. 1) via a fuel mixture spring 22 and linked to a throttle lever 23 for accelerating or decelerating engine speed. A first air link 24 is linked to the on-off valve 12*a* of the air flow rate controller 12 (shown in FIG. 1) via a first air spring 25 and linked to the throttle lever 23 for accelerating or decelerating engine speed by a second air link 26 via a shock absorber 30, together with the fuel mixture link 21. In the shock absorber 30, in an example shown, a second air spring 27 is inserted between the first air link 24 and the second air link 26, and a spring constant Ka of the second air spring 27 is set in a lower range than a spring constant Kb of the first air spring 25. Although a spring is used for the shock absorber 30 in the aforesaid embodiment, an assistant cylinder, an accumulator, or the like can be also used.

Figure 4:
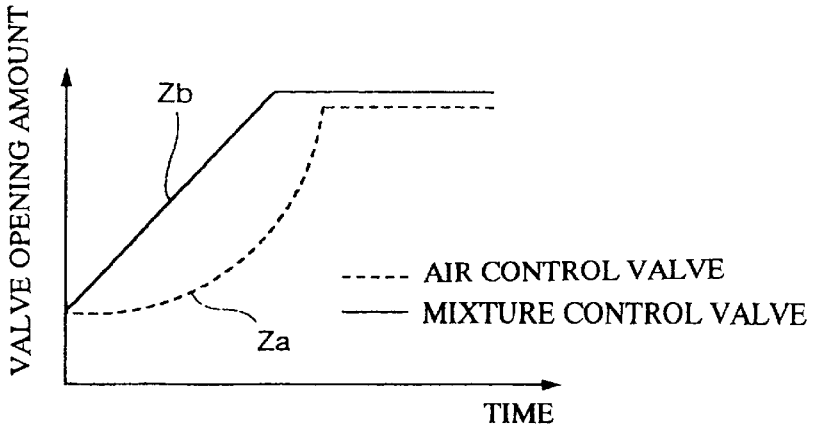
FIG. 4 is a diagram for explaining the relationship between points in time and valve openings in the first embodiment of the air supply delay device.

Next, operation will be described with reference to FIG. 3 and FIG. 4. When an operator wants to accelerate the engine, the throttle lever 23 is manipulated in an accelerating direction. A movement of the throttle lever 23 in the accelerating direction is transmitted to the throttle valve 11*a* via the fuel mixture link 21 and the fuel mixture spring 22, whereby the throttle valve 11*a* of the fuel mixture flow rate controller 11 is rotated to be opened further. Thus, the flow rate of a fuel mixture drawn into the crank chamber 1*a* is further increased and drawn in accordance with the amount of throttle lever 23 manipulation, as shown in a full line Zb in FIG. 4. At the same time, the movement of the throttle lever 23 in the accelerating direction rotates the on-off valve 12*a* of the air flow rate controller 12 to be opened via the second air link 26, the shock absorber 30, and the first air link 24, in sequence. At this time, in the shock absorber 30, the second air spring 27 having the lower spring constant Ka is bent responsive to a movement of the second air link 26, and the air first link 24 is moved after the second air spring 27 is bent by a predetermined amount. Accordingly, after receiving movement of the second air link 26, the shock absorber 50 moves the first air link 24 with delay. Thus, in the opening amount of the on-off valve 12*a* of the air flow rate controller 12, delay is brought about by the shock absorber 30 as shown in a dotted line Za in FIG. 4, and the on-off valve 12*a* is opened to a predetermined position which is set by the throttle lever 23 later than the throttle valve 11*a* at all times. By delay of the air quantity to be supplied, a lower air-fuel ratio fuel mixture fills the cylinder chamber 4*a*, thus improving acceleration performance of the engine. At this time, with the delay of the air to be supplied, the total amount of fuel fed to the fuel mixture is smaller than in the prior art, whereby exhaust gas at the time of acceleration can be made cleaner than in the prior art. Moreover, since the supply amount of fuel no longer needs to be determined in view of an air-fuel ratio at the time of acceleration, the supply amount of fuel can be set in a lower range at a stationary engine speed, and exhaust gas can be made cleaner than in the prior art.

Figure 5:
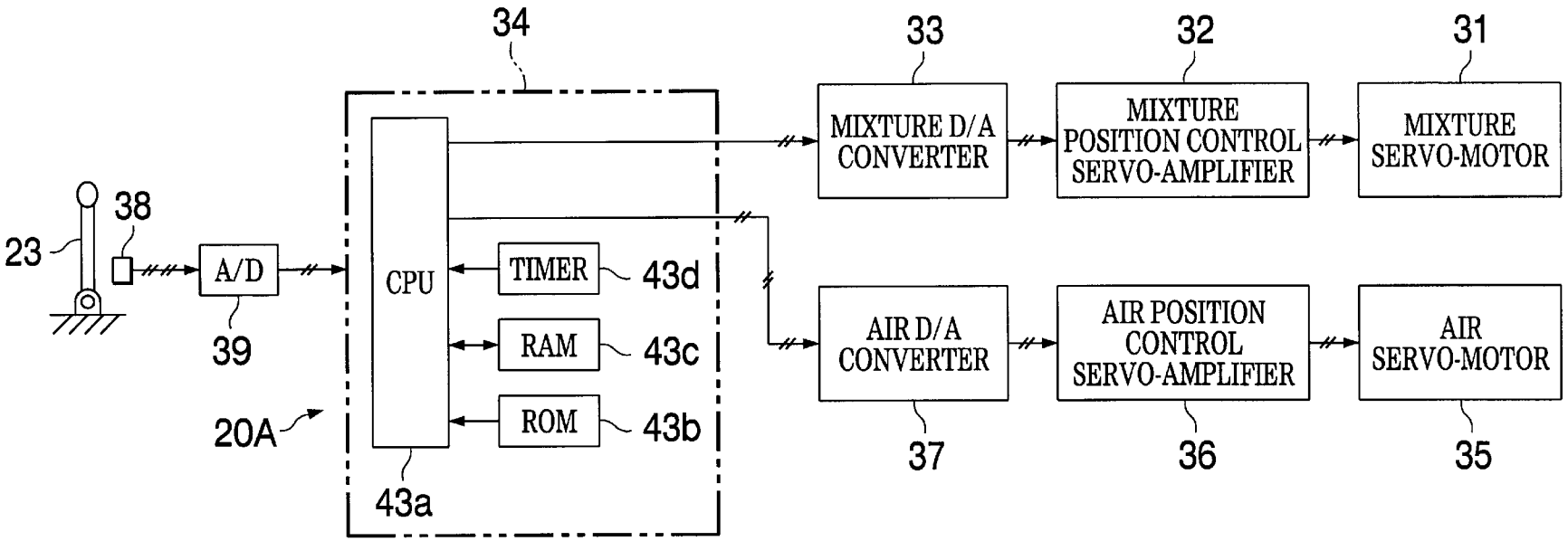
FIG. 5 is a block diagram of a second embodiment of the air supply delay device for the one embodiment of the present invention.

Referring now to FIG. 1 and FIG. 5, which show a schematic diagram of a second embodiment of an air supply delay device 20A which supplies a later air flow rate. Incidentally, the second embodiment is electronically controlled, which shows an example in which the opening amount of the on-off valve 12*a* of the air flow rate controller 12 is throttled more than that of the throttle valve 11*a* of the mixture flow rate controller 11. A fuel mixture servo-motor 31 is attached to the throttle valve 11*a* of the fuel mixture flow rate controller 11. The fuel mixture servo-motor 31 is connected to a control element 34, such as a digit controller, via a fuel mixture position control servo amplifier 32 and a fuel mixture D/A converter 33 and operates in accordance with commands from the control element 34. An air servo-motor 35 is attached to the on-off valve 12*a* of the air flow rate controller 12, the air servo-motor 35 being connected to the control element 34, such as a digital controller, via an air position control servo amplifier 36 and an air D/A converter 37 and operates in accordance with commands from the control element 34. Provided in the throttle lever 23 is a movement sensor 38 for detecting the amount of movement (or the amount of rotation) of the throttle lever 23. A signal from the movement sensor 38 is inputted to the control element 34 via an A/D converter 39. A CPU 43*a*, a ROM 43*b*, a RAM 43*c*, and a timer 43*d* are provided in the control element 34. Although an example in which the servo-motors 31,35 are used for opening and closing the throttle valve 11*a* and the on-off valve 12*a* is shown above, an electromagnetic proportional control valve which controls a flow rate with a solenoid, a step motor, or the like may be used.

Figure 6:
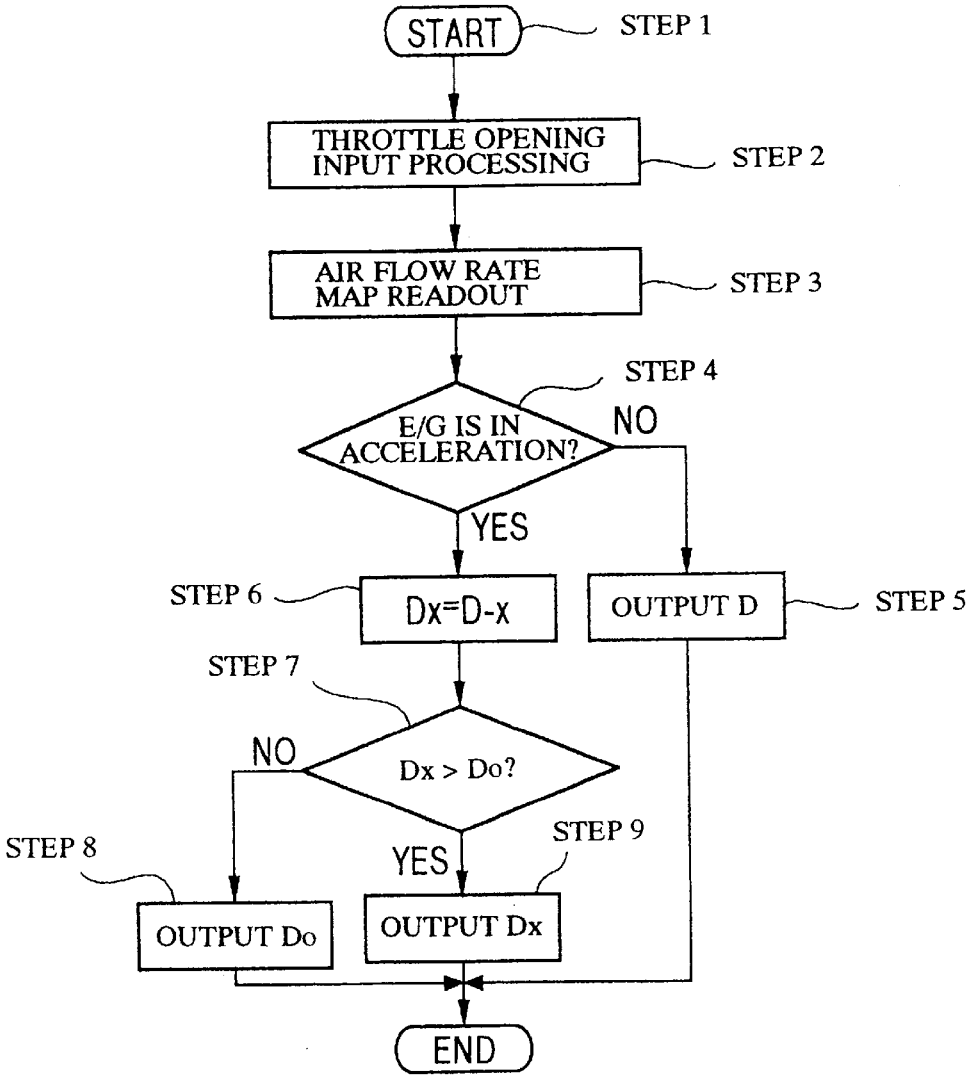
FIG. 6 is a flowchart of the second embodiment of the air supply delay device for the one embodiment of the present invention.

Next, operation will be described, based on a flowchart shown in FIG. 6 with reference to FIGS. 1 and 5.

At START in step 1, when the engine starts, the control element 34 executes control operations at regular intervals, for example, at 10 msec intervals by interrupt of a timer 43*d*.

In step 2, input processing of throttle openings is executed. A voltage value according to the amount of movement from the movement sensor 38 is converted to a digital value through the A/D converter 39 to be inputted to the CPU 43*a*. In the control element 34, address data corresponding to a throttle opening, which is already stored in the RAM 43*c*, are moved to data stored in an address corresponding to the preceding throttle opening, and data corresponding to a throttle opening which is inputted to the CPU 43*a* from the A/D converter 39 this time is stored in an address corresponding to a throttle opening which is already stored. In addition, the control element 34 converts a voltage value according to the amount of movement from the movement sensor 38 to a digital value through the A/D converter 39 and receives it in the CPU 43*a*, and subsequently outputs an opening command to the mixture servo-motor 31 so that the flow rate of a fuel mixture is in accord with the amount of movement stored in the ROM 43*b* flows.

In step 3, data of an address corresponding to an air flow rate map stored in the ROM 43*c* are read out from the present throttle opening, which is obtained in step 2.

In step 4, data of a throttle opening obtained last time and data of a throttle opening obtained this time are compared, and whether the engine is in acceleration or not is determined from whether the throttle opening obtained this time is increased more than the throttle opening obtained last time or not.

When the throttle opening obtained this time is the same as or is smaller than the throttle opening obtained last time in step 4, the procedure advances to step 5.

In step 5, when the throttle opening obtained this time is the same as the throttle opening obtained last time, the same command value as that of the throttle opening obtained last time is outputted to the on-off valve 12*a* of the air flow rate controller 12 as an opening command, and when the throttle opening obtained this time is smaller than the throttle opening obtained last time, a command value for letting the flow rate of air according to the amount of movement of the throttle lever 23, which is stored in the ROM 43*c* flow, is outputted to the on-off valve 12*a* of the air flow rate controller 12 as an opening command, respectively. The control element 34 outputs an opening command to the fuel mixture servo-motor 31 so that a flow rate of a fuel mixture is in accord with an amount of movement of the throttle lever 23 stored in the ROM 43*c*. Further in the above, the mixture flow rate controller 11 may be a mechanical control means, which uses the mixture link 21 shown in FIG. 3, without being electronically controlled.

When the throttle opening obtained this time is larger than the throttle opening obtained last time in step 4, the procedure advances to step 6 after the amount of acceleration is obtained.

In step 6, predetermined throttle amount data X, according to the amount of acceleration stored in the ROM 43*c* are subtracted from air quantity data D, found from the air flow rate map obtained in step 3, to find throttle air flow rate data Dx.

In step 7, whether the throttle air flow rate data Dx obtained in step 6 are larger than minimum air flow rate data Do of the engine or not is determined.

When the throttle air flow rate data Dx are smaller than the minimum air flow rata data Do, the procedure advances to step 8.

In step 8, the CPU 43*a* outputs the minimum air flow rate data Do to the air D/A converter 37, and the air D/A converter 37 converts the data to a predetermined voltage value to be outputted to the air position control servo amplifier 36. The air position control servo amplifier 36 rotates the air servo-motor 35 to a position proportional to the voltage value. The control element 34 outputs an opening command to the mixture servo-motor 31 so that the flow rate of a fuel mixture is in accord with the amount of movement of the throttle lever 23 stored in the ROM 43*c*. Further in the above, the fuel mixture flow rate controller 11 may be a mechanical control means which uses the mixture link 21 shown in FIG. 3 without being electronically controlled.

When the throttle air flow rate data Dx is larger than the minimum air flow rate data Do in step 7, the procedure advances to step 9.

In step 9, the CPU 43*a* outputs the throttle air flow rate data Dx to the air D/A converter 37, and the air D/A converter 37 converts the data to a predetermined voltage value to be outputted to the air position control servo amplifier 36. The air position control servo amplifier 36 rotates the air servo-motor 35 to a position proportional to the voltage value so that the on-off valve 12*a* of the air flow rate controller 12 is throttled. The control element 34 outputs an opening command to the fuel mixture servo-motor 31 so that the flow rate of a fuel mixture is in accord with the amount of movement of the throttle lever 23 stored in the ROM 43*c*. Further in the above, the mixture flow rate controller 11 may be a mechanical control means which uses the fuel mixture link 21 shown in FIG. 3 without being electronically controlled.

Figure 7:
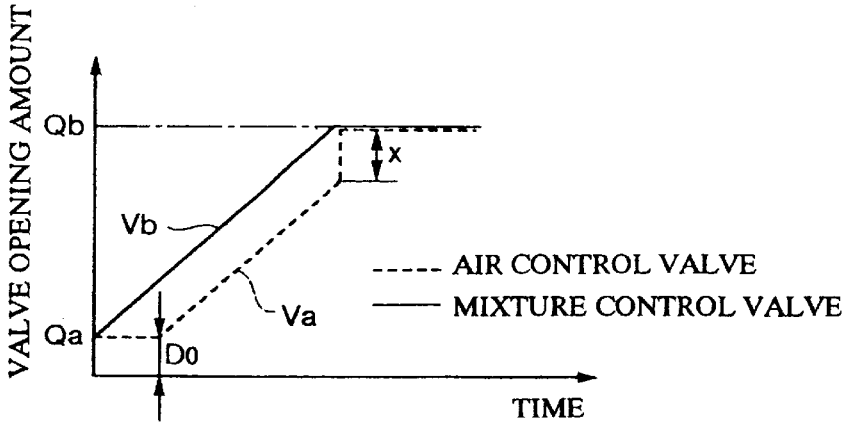
FIG. 7 is a diagram for explaining the relationship between points in time and valve openings in the second embodiment of the air supply delay device.

As shown with a dotted line Va in FIG. 7 with reference to FIGS. 1 and 5, the on-off valve 12*a* of the air flow rate controller 12 is throttled more than the throttle valve 11*a* of the fuel mixture flow rate controller 11 by the throttle amount data X, and the air servo-motor 35 operates while being throttled more than the fuel mixture servo-motor 31. Therefore, a supplied air quantity is decreased, and a fuel mixture having a lower air-fuel ratio fills the cylinder chamber 4*a*, thus improving acceleration performance of the engine. In FIG. 7, the horizontal axis represents time, the vertical axis represents the opening amount of a valve, the dotted line Va shows the case of the on-off valve 12*a* of the air flow rate controller 12, and a full line Vb shows the case of the throttle valve 11*a* of the mixture flow rate controller 11. When a valve opening amount Qa is changed to an acceleration valve opening amount Qb in the drawing, the opening amount of the throttle valve 11*a* of the fuel mixture flow rate controller 11 increases as shown with the full line Vb, and the opening amount of the on-off valve 12*a* of the air flow rate controller 12 remains in a position where it is for a predetermined period of time as shown with a dotted line Va. As a result, the opening amount of the on-off valve 12*a* of the air flow rate controller 12 increases later than the opening amount of the throttle valve 11*a* of the fuel mixture flow rate controller 11 while being throttled more than the opening amount of the throttle valve 11*a* of the fuel mixture flow rate controller 11. Thus, similar to the above, with delay in an air quantity to be supplied, the total amount of fuel fed to the fuel mixture is smaller than in the prior art, whereby exhaust gas at the time of acceleration can be made cleaner than in the prior art. Moreover, since the supply amount of fuel no longer needs to be determined in view of an air-fuel ratio at the time of acceleration, the supply amount of fuel can be set in a lower range at a stationary engine speed, and exhaust gas can be made cleaner than in the prior art.

Figure 8:
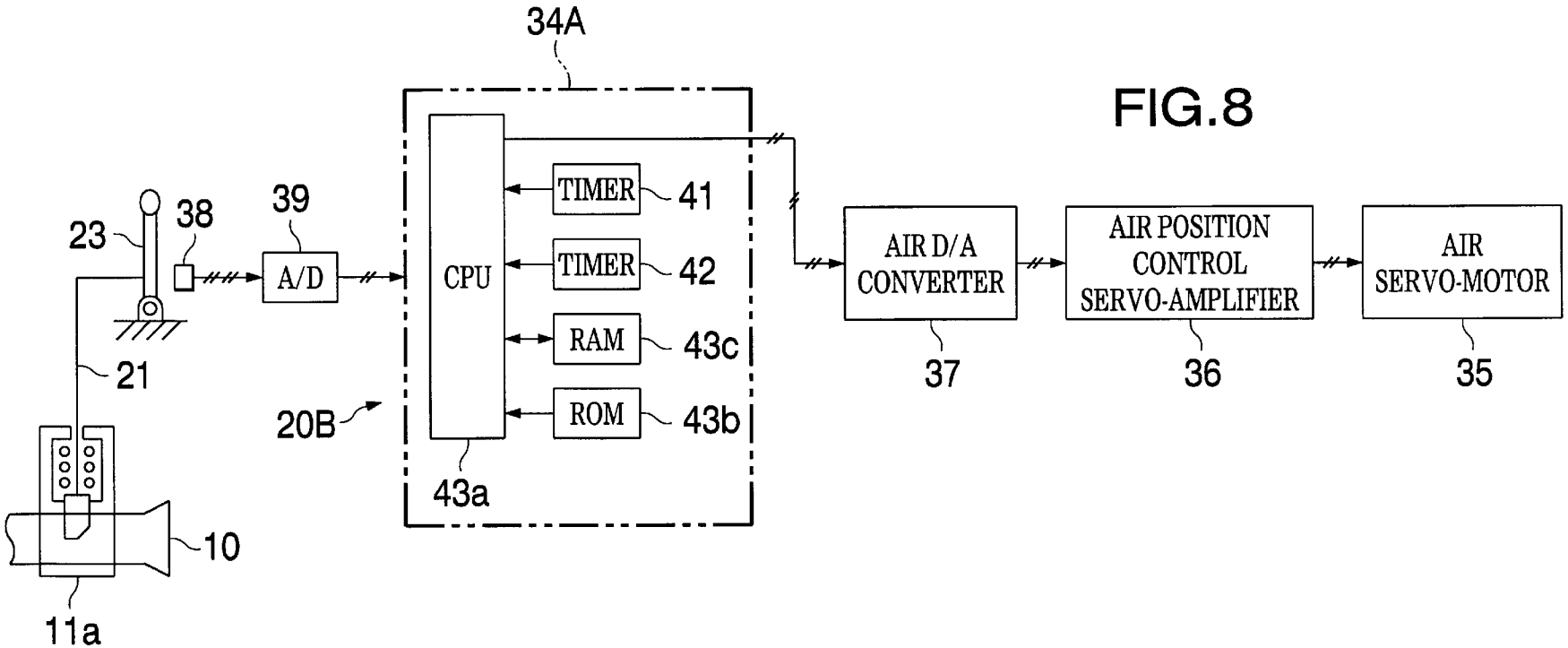
FIG. 8 is a block diagram of a third embodiment of the air supply delay device for the one embodiment of the present invention.

Referring now to FIG. 8, a third embodiment of an air supply delay device 20B is described, with reference also to FIGS. 3 and 5. The configuration of parts of the third embodiment is different from that of the second embodiment shown in FIG. 5 in that: two timers 41 and 42 are provided in a control element 34A; the mixture D/A converter 33, the mixture position control servo amplifier 32, and the mixture servo-motor 31 are omitted; and the throttle valve 11*a* in the fuel mixture flow rate controller 11 is connected to the throttle lever 23 via the fuel mixture link 21. A controlling method of the third embodiment is an example in which the opening of the on-off valve 12*a* of the air flow rate controller 12 is made later than the throttle valve 11*a* of the fuel mixture flow rate controller 11. Incidentally, the same parts as those in FIG. 5 are denoted by the same numerals and symbols and the explanation thereof is omitted.

Figure 9:
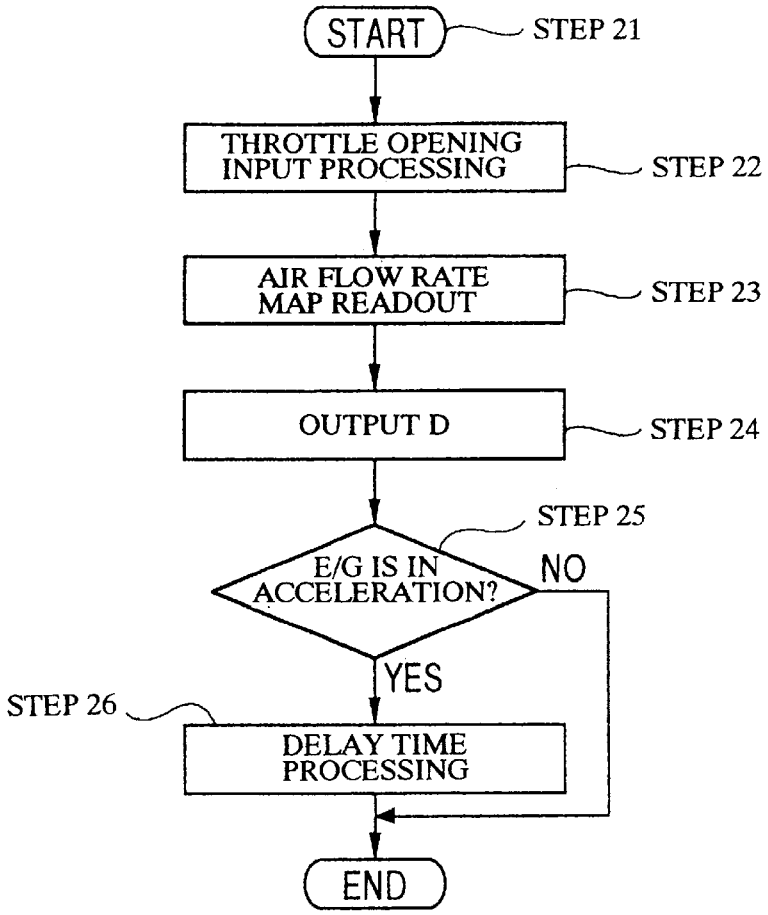
FIG. 9 is a flowchart of the third embodiment of the air supply delay device according to the present invention.

The controlling method by the control element 34A will be described, based on a flowchart shown in FIG. 9 with reference to FIGS. 1 and 8.

At START in step 21, when the engine starts, the control element 34A executes control operations at regular intervals, for example, at 10 msec intervals by interrupt of a timer 41.

In step 22, input processing of throttle openings is executed. A voltage value according to the amount of movement from the movement sensor 38 is converted to a digital value through the A/D converter 39 to be inputted to the CPU. In the control element 34A, data of an address corresponding to a throttle opening, which is already stored in the RAM 43*c*, are moved to data stored in an address corresponding to the preceding throttle opening, and data corresponding to a throttle opening, which is inputted to the CPU 43*a* from the A/D converter 39 at this time, are stored in an address corresponding to a throttle opening which is already stored.

In step 23, data of an address corresponding to an air flow rate map stored in the ROM 43*c* are read out from the present throttle opening, which is obtained in step 22.

In step 24, data of an address corresponding to the air flow rate map stored in the ROM 43*b* from the present throttle opening which is obtained in step 23 is outputted to the air D/A converter 37, and the air D/A converter 37 converts the data to a predetermined voltage value to be outputted to the air position control servo amplifier 36. The air position control servo amplifier 36 rotates the air servo-motor 35 to a position proportional to the voltage value.

In step 25, data of the throttle opening obtained last time and data of a throttle opening obtained this time are compared, and whether the engine is in acceleration or not is determined from whether the throttle opening obtained this time is increased more than the throttle opening obtained last time or not.

When the throttle opening obtained this time is the same as or is smaller than the throttle opening obtained last time in step 25, the air servo-motor 35 is rotated to a position at which output is conducted to the air D/A converter 37 in step 24.

When the throttle opening obtained this time is larger than the throttle opening obtained last time in step 25, the procedure advances to step 26.

Figure 10:
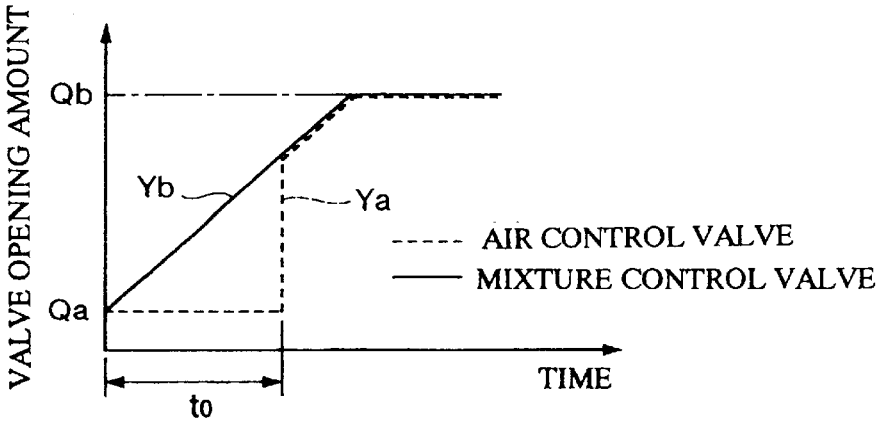
FIG. 10 is a diagram for explaining the relationship between points in time and valve openings in the third embodiment of the air supply delay device.

In step 26, a delay time $t_o$ is counted by a timer 42, during which interrupt for executing control operations by the timer 41 is prevented. After the delay time $t_o$ is counted by the timer 42 interrupt is resumed. Thus, the air servo-motor 35 starts to operate later than the throttle valve 11*a* in the fuel mixture flow rate controller 11. Consequently, as shown with a dotted line Ya in FIG. 10, the on-off valve 12*a* of the air flow rate controller 12 starts to operate later than the throttle valve 11*a* of the fuel mixture flow rate controller 11 by the delay time $t_o$, whereby delay in an air quantity to be supplied occurs and a thicker air-fuel ratio fuel mixture fills the cylinder chamber 4*a*, thus improving acceleration performance of the engine. In FIG. 10, the horizontal axis represents time, the vertical axis represents the opening amount of a valve, a dotted line Ya shows the case of the on-off valve 12*a* of the air flow rate controller 12, and a full line Yb shows the case of the throttle valve 11*a* of the fuel mixture flow rate controller 11. When a valve opening amount Qa is changed to an acceleration valve opening amount Qb (in the drawing), the opening amount of the throttle valve 11*a* of the fuel mixture flow rate controller 11 increases, as shown with the full line Yb, and the opening amount of the on-off valve 12*a* of the air flow rate control means 12 increases after the delay time $t_o$ as shown with the dotted line Ya, and subsequently increases similarly to that of the throttle valve 11*a* of the fuel mixture flow rate controller 11. As a result, the same effect that is described above can be obtained at the time of acceleration, and moreover since an air quantity increases when predetermined acceleration is obtained, the air-fuel ratio becomes the same as that at a stationary engine speed, whereby acceleration performance can be improved, and exhaust gas after acceleration can be made cleaner than in the prior art.

In the aforesaid embodiment, the on-off valve 12*a* is structured to be throttled by detecting that the throttle valve 11*a* is changing in an opening direction. Specifically, when the throttle valve 11*a* is changing in an opening direction, the engine is regarded as being then subject to acceleration, whereby the on-off valve 12*a* is throttled. However, the engine may be also regarded as being subject to acceleration by an increase in engine speed, and thereby the on-off valve 12*a* is structured to be throttled. Namely, the on-off valve 12*a* may be structured to throttle an opening by detecting that the rotational frequency of the crankshaft 5 is changing in an increasing direction, for example.

INDUSTRIAL AVAILABILITY

The present invention is useful as a stratified scavenging two-cycle engine, in which control of an air flow rate provides favorable accelerating performance and can prevent deterioration of exhaust gas.

What is claimed is:

1. A stratified, scavenging, two-cycle engine having a cylinder chamber and a crank chamber, the engine comprising:

a fluid flow passage extending between the cylinder chamber and the crank chamber;

an air flow passage, in fluid communication with the fluid flow passage, to introduce air to the fluid flow passage;

an air flow controller to control a quantity of air introduced from the air flow passage to the fluid flow passage; and a fuel mixture controller to control a quantity of a fuel mixture provided to the crank chamber from a coupled fuel mixture flow passage, wherein the engine effects a reduction of air introduced from the air flow passage to the fluid flow passage at engine acceleration.

2. An engine in accordance with claim 1, wherein the air flow controller throttles the quantity of air introduced from the air flow passage to the fluid flow passage at engine acceleration.

3. An engine in accordance with claim 1, wherein the air flow controller delays introduction of a conventional air flow to the fluid flow passage a prescribed time after the quantity of a fuel mixture is provided to the crank chamber.

4. An engine in accordance with claim 1, further comprising an engine acceleration mechanism, coupled to the air flow controller, to determine an engine acceleration.

5. An engine in accordance with claim 4, wherein the engine acceleration mechanism monitors variations in user inputs.

6. An engine in accordance with claim 1, wherein the air flow controller includes a first mechanism to open and close the air flow passage and a second mechanism, connected to the first mechanism, to control actuation of the first mechanism in response to a user input.

7. A stratified, scavenging, two-cycle engine having a cylinder chamber and a crank chamber, the engine comprising:

a fluid flow passage extending between the cylinder chamber and the crank chamber;

an air flow passage, in fluid communication with the fluid flow passage, to introduce air to the fluid flow passage;

an air flow controller to control a quantity of air introduced from the air flow passage to the fluid flow passage; and a fuel mixture controller to control a quantity of a fuel mixture provided to the crank chamber from a coupled fuel mixture flow passage, wherein at engine acceleration, the air flow controller controls the quantity of air introduced from the air flow passage to the fluid flow passage after delaying such introduction a prescribed time after a fuel mixture is drawn into the crank chamber.

8. An engine in accordance with claim 7, further comprising a controller, coupled to the fuel mixture controller and the air flow controller, to manage cooperative operations of the fuel mixture controller and the air flow controller.

9. An engine in accordance with claim 7, further comprising an engine acceleration mechanism, coupled to the air flow controller, to determine an engine acceleration.

10. An engine in accordance with claim 9, wherein the engine acceleration mechanism monitors variations in user inputs.

11. An engine in accordance with claim 7, wherein the air flow controller includes a first mechanism to open and close the air flow passage and a second mechanism, connected to the first mechanism, to control actuation of the first mechanism in response to a user input.

12. A method for controlling an introduction of a fuel mixture and an introduction of air to a stratified, scavenging, two-cycle engine, the method comprising the steps of:

providing an engine having a fluid flow passage extending between a cylinder chamber and a crank chamber, and an air flow passage, in fluid communication with the fluid flow passage, to introduce air to the fluid flow passage;

controlling a flow rate of a fuel mixture drawn into the crank chamber;

controlling a flow rate of air introduced to the fluid flow passage; and detecting an engine acceleration, wherein upon detecting an engine acceleration, reducing the flow rate of air introduced to the fluid flow passage for a prescribed time.

13. A method in accordance with claim 12, wherein the step of reducing the flow rate of air includes throttling the flow rate of air introduced to the fluid flow passage.

14. A method in accordance with claim 12, wherein the step of reducing the flow rate of air includes delaying introduction of a conventional air flow to the fluid flow passage by a prescribed time after a fuel mixture flow is drawn into the crank chamber.

* * * * *